United States Patent [19]

Karakida et al.

[11] Patent Number: 5,008,170

[45] Date of Patent: Apr. 16, 1991

[54] PHOTORECEPTOR FOR ELECTROPHOTOGRAPHY

[75] Inventors: Kenichi Karakida; Shigeru Yagi; Yuzuru Fukuda; Masayuki Nishikawa; Te N. Roh; Noriyoshi Takahashi; Masato Ono; Masaki Yokoi; Yumiko Komori, all of Kanagawa, Japan

[73] Assignee: Fuji Xerox Co., Ltd., Tokyo, Japan

[21] Appl. No.: 370,312

[22] Filed: Jun. 23, 1989

[30] Foreign Application Priority Data

Jun. 24, 1988 [JP] Japan ..... 63-154796

[51] Int. Cl.[5] ..... G03G 5/14

[52] U.S. Cl. ..... 430/65; 430/66

[58] Field of Search ..... 430/58, 84, 95, 65, 430/66

[56] References Cited

U.S. PATENT DOCUMENTS 4,673,629 6/1987 Yamazaki et al. ..... 430/58

4,810,606 3/1989 Iino et al. ..... 430/58

*Primary Examiner*—John Goodrow

*Attorney, Agent, or Firm*—Finnegan, Henderson, Farabow, Garrett, and Dunner

[57] ABSTRACT

A photoreceptor for electrophotography, comprising: a photoconductive layer substantially composed of amorphous silicon, and first, second and third surface layers substantially composed of amorphous silicon added with nitrogen atom, those layers being formed on a support. The thickness $d_1$, $d_2$ and $d_3$ of the first, second and third surface layers satisfies the following relation: $d_2 > d_1$ and $d_2 > d_3$, and the nitrogen concentrations $c_1$, $c_2$ and $c_3$ of said first, second and third surface layers satisfy the following relation: $c_3 > c_2 > c_1$.

6 Claims, 1 Drawing Sheet

PHOTORECEPTOR FOR ELECTROPHOTOGRAPHY

BACKGROUND OF THE INVENTION

1. Field of the Invention

The present invention relates to a photoreceptor for electrophotography that contains amorphous silicon.

2. Prior Art

The life of a photoreceptor for use in electrophotography is known to be chiefly governed by such factors as the deterioration of its electrical properties, the occurrence of flaws on its surface, and the changes (especially the thermal change) in the properties of the materials of which the photoreceptor is made. Photoreceptors made of amorphous silicon based materials have recently been the subject of intensive studies by many researchers because it is anticipated that such materials will be completely free from the restraints of the various factors that have governed the life of conventional photoreceptors. In other words, since amorphous silicon materials retain stable electrical characteristic over cyclic use, have high hardness, and are thermally stable, they have the potential to provide an extremely long-lived photoreceptor.

Beside its potential for extending the life of photoreceptors, amorphous silicon has a high photosensitivity in the range of longer wavelength than conventional materials and its sensitivity can be further extended into the range of still longer wavelength by selecting an appropriate formulation. Therefore, photoreceptors made of amorphous silicon can be used with printers that employ small and low-cost semiconductor lasers as light sources.

In spite of these advantages that increase its potential for use as the material of a photoreceptor, amorphous silicon has its own problems in practice in terms of dark resistance, photosensitivity at long wavelengths, mechanical strength properties (in particular, ductility), time-dependent stability, and dependency of image quality on environmental factors (i.e., temperature and humidity).

Amorphous silicon materials have high hardness (their Vickers hardness is on the order of $10^3$) but if they are brought into contact with less hard materials (e.g. the edge of copying paper and the cleaning blade in a copying machine), the area of contact will fail to produce an image and remain as white dots. It is also known that a photoreceptor made of amorphous silicon experiences a reduced resolution (i.e., dilation) if it is cyclically used for fairly long period in a copying machine (or printer). This is probably due to the deposition of foreign matter on the surface of the photoreceptor and/or to the change in the proterties of the photoreceptor. The phenomenon of dilation can also materialize for reasons associated with the structure of the photoreceptor (e.g. use of an inappropriate surface layer) and if this is the case, the phenomenon will occur in the initial period of use, that is, within a few cycles to several tens of cycles of operation.

The applicants of the present invention previously resolved the aforementioned problems by proposing an amorphous silicon photoreceptor having two amorphous silicon surface layers containing different concentrations of nitrogen atoms as disclosed in U.S. Ser. No. 061,964 filed on June 15, 1987.

However, the above photoreceptor, if the overall film thickness of the surface layers is set so as to satisfy the resistance to printing which is required according to the various conditions in a copying machine or a printer used, it has been difficult to satisfy the requirements for the residual potential and the sensitivity to a short wavelength light (in the vicinity of 500 nm). That is, the residual potential is proportional to the concentration of nitrogen atoms in the surface layers, while the absorption coefficient of the surface layer for the short wavelength light is inversely proportional to the concentration of nitrogen atoms. Accordingly, when the concentration of nitrogen atoms is lowered to reduce the residual potential, there occurs a problem that the sensitivity to light is reduced due to absorption by the surface layers.

SUMMARY OF THE INVENTION

An object of the present invention is to provide a photoreceptor for electrophotography which has an excellent resistance performance to printing, low residual potential and high light sensitivity over the entire range of the visible light region.

Another object of the present invention is to provide a photoreceptor for electrophotography which can provide an initial image of high quality and has an excellent stability against the passage of the time.

Another object of the present invention is to provide a photoreceptor for electrophotography which has a high dark resistance and an excellent electrification capacity.

Another object of the present invention is to provide a photoreceptor for electrophotography which has a small dependence of the properties thereof on the environment in which the photoreceptor is used.

Another object of the present invention is to provide a photoreceptor for electrophotography which can provide stable and high initial picture quality in any environment where the photoreceptor is used, and will not be deteriorated even for repetitive use.

The above objects of the present invention can be achieved by the following structural features. The photoreceptor according to this invention includes: a photoconductive layer comprising an amorphous silicon base, a first surface layer, a second surface layer and a third surface layer laminated sequentially on a substrate in this order. Each of the first, second and third surface layers includes amorphous silicon as a principal ingredient and is doped with nitrogen atoms and the film thicknesses $d_1$, $d^2$, and $d^3$ of the first, second and third surface layers satisfy the conditions $d_2 > d_1$ and $d_2 > d_3$. Further, the nitrogen concentrations $c_1$, $c_2$ and $c_3$ of the first, second and third surface layers satisfy the relation $c_3 > c_2 > c_1$.

In addition, the above objects of the present invention can be accomplished more effectively by adding 0.01–100 ppm atoms of a group III element to the photoconductive layer of the photoreceptor. The effect of the present invention can be made more conspicuous by providing between the substrate and the photoconductive layer a charge injection blocking layer of amorphous silicon which is added with 1–5,000 ppm atoms of a group III or a group V element.

Moreover, in the photoreceptor of the present invention, a charge capturing layer of amorphous silicon which contains 0.1–5,000 ppm atoms of a group III or a group V element may be provided between the photoconductive layer and the first surface layer to accomplish this invention more effectively.

DETAILED DESCRIPTION OF THE INVENTION

The preferred embodiment of this invention will be described with reference to the accompanying drawings.

Figure 1:
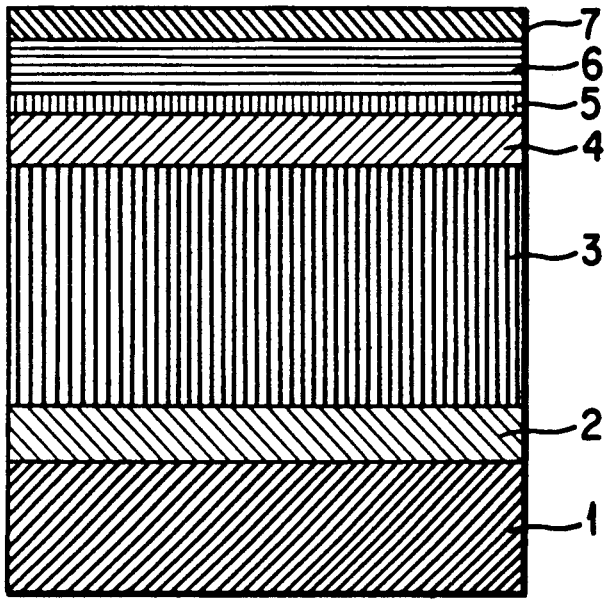
FIG. 1 is a schematic diagram showing the construction of the photoreceptor according to the present invention.

FIG. 1 is a schematic diagram illustrating the typical structure of the photoreceptor of the present invention. The photoreceptor comprises a substrate 1, a charge injection blocking layer 2, a photoconductive layer 3, a charge capturing layer 4, and first, second and third surface layers 5, 6 and 7, respectively. The charge injection blocking layer 2 comprises amorphous silicon which is added with 1-5,000 ppm atoms of a group III or a group V element. The preferable quantity of the additive is in the range of 5-1,000 ppm. The photoconductive layer 3 is amorphous silicon which is added with 0.01-100 ppm atoms of a group III or a group V element. The preferable quantity of the additive is in the range of 0.05-50 ppm. The charge capturing layer 4 comprises amorphous silicon which is added with 0.1-5,000 ppm atoms of a group III or a group V element. The preferable quantity of the additive is in the range of 1-1,000 ppm. The surface layers 5, 6 and 7 comprise amorphous silicon which is added with nitrogen atoms, and when their film thicknesses are represented by $d_1$, $d_2$ and $d_3$, and their nitrogen atom concentrations are represented by $c_1$, $c_2$ and $c_3$, respectively, they satisfy the following relations: $d_2>d_1$, $d_2>d_3$ and $c_3>c_2>c_1$.

As for the substrate 1, depending upon the need, appropriate choice may be made from among metals such as aluminum, nickel, chrome and stainless steel, and a plastic sheet, glass, and paper having an electrically conductive film.

Each of the layers 2 to 7 is a layer having amorphous silicon as the main body, and may be formed by means of the glow discharge decomposition method, sputtering method, ion plating method, vacuum deposition method or the like. With the glow discharge decomposition method as an example, the method of manufacture proceeds as follows. First, as the raw material gas, the mixture of the main raw material gas containing silicon atoms and a raw material gas containing required additive atoms is used. In this case, a carrier gas such as a hydrogen gas or an inert gas may be added to the above mixture. The film formation is carried out in the following conditions: frequency of 0-5 GHz, internal reactor pressure of $10^{-5}$-10 Torr (0.001-1,330 Pa), discharge power of 10-3,000 W, and the substrate temperature of 30°-300° C. The film thickness of the each layer can be set appropriately by adjusting the discharge time. In addition, silanes, especially $SiH_4$ and/or $Si_2H_6$ are used as the main raw material gas.

The charge injection blocking layer 2 comprises amorphous silicon which is added with a group III or group V element. The film thickness is preferably in the range of 0.01-10 μm. The decision as to the choice of a group III or group V element is made by the sign of the charge on the photoreceptor. In forming the film, diborane ($B_2H_6$) is typically used as a raw material gas containing a group III element, and phosphine ($PH_3$) is typically used as a raw material gas containing a group V element. To the charge injection blocking layer having amorphous silicon as the main body, other elements, in addition to a group III or group V element, may also be added for various purposes.

The photoconductive layer 3 comprises amorphous silicon which is added with a group III element. The film thickness is preferably in the range of 1-100 μm. Diborane is typically used as the raw material gas containing the group III element. To the photoconductive layer having amorphous silicon as the main body, other elements may be further added in addition to the group III element for various purposes. Further, the photoconductive layer may be formed by a charge generating layer and a charge transporting layer.

The charge capturing layer 4 comprises amorphous silicon which is added with a group III element or a group V element. The film thickness is preferably in the range of 0.01-10 μm. The selection of a group III element or a group V element for use is determined by the sign of the charge on the photoreceptor. Diborane is typically used as the raw material gas containing a group III element, and phosphine is typically used as a raw material gas containing a group V element. To the charge capturing layer having amorphous silicon as the main body, other elements, in addition to the group III or group V element, may also be added for various purposes.

Each of the surface layers 5, 6 and 7 comprises amorphous silicon which is added with nitrogen atoms. As the raw material gas containing nitrogen atom in the film formation, any simple substrance or compound having nitrogen atom as a component may be employed as long as it is usable in vapor phase. As examples, $N_2$ gas or a gas of hydrogenated nitrogen compounds such as $NH_3$, $N_2H_4$ and $HN_3$ may be used. The raw material gas containing nitrogen atom to be used for various surface layers may be identical or may be different. In addition, other elements may also be added to the respective surface layers for various purposes.

In the present invention, when the nitrogen atom concentrations of the surface layers 5, 6 and 7 are represented by $c_1$, $c_2$ and $c_3$, and their film thicknesses are represented by $d_1$, $d_2$ and $d_3$, respectively, these quantities have to satisfy the relations $c_3>c_2>c_1$, $d_2>d_1$ and $d_2>d_3$.

The nitrogen atom concentration in the first surface layer 5 is preferably in the range of 0.1-1.0 in terms of the atom number ratio to silicon. In addition, the film thickness thereof is preferably in the range of 0.01-0.1 μm.

The nitrogen atom concentration in the second surface layer 6 is preferably in the range of 0.1-1.0 in terms of the atom number ratio to silicon. The film thickness thereof is preferably in the range of 0.05-1 μm.

The nitrogen atom concentration in the third surface layer 7 is preferably in the range of 0.5-1.3 in terms of the atom number ratio to silicon. Further, the film thickness thereof is preferably in the range of 0.01-0.1 μm.

The photoreceptor of the present invention may be used in any electrophotographic process. However, it can be used more effectively in an electrophotographic process which is operated under the condition that at least the surface of the photoreceptor is heated at 35°-50° C. because when the photoreceptor is used under the above heat-condition, a stable and high-quality initial image can be obtained in any environment, and it will not be deteriorated in image quality by repetitive use.

Such an electrophotographic process will be described with reference to FIG. 2.

Figure 2:
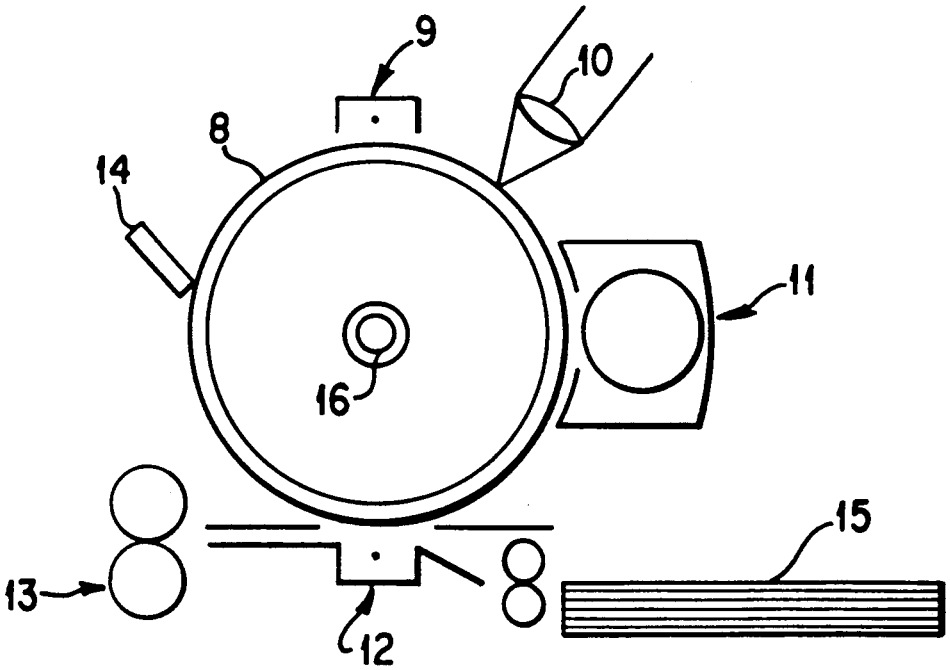
FIG. 2 is an explanatory diagram showing the schematic construction of the electrophotographic apparatus using the photoreceptor of the present invention.

FIG. 2 shows a schematic construction of an electrophotographic device using a photoreceptor of the present invention. Reference numeral 8 represents a photoreceptor according to the present invention; 9, electrifying means for uniformly electrifying the photoreceptor in a dark place; 10, latent image forming means for forming a latent image in the photoreceptor by exposing the photoreceptor to an optical image corresponding to an original image; 11, developing means for developing the latent image into a visible image with toner powder; 12, transfer means for transferring the developed image onto a transfer member; 13, fixing means for fixing the transferred image; 14, cleaning means; 15, a transfer paper; and 16, photoreceptor heating means comprising a rotary shaft and a quartz lamp mounted therein.

The means for heating the photoreceptor may be provided at an arbitrary position. Although the photoreceptor heating means 16 is provided within the rotary shaft for rotating photoreceptor 8 the as shown in FIG. 2, it may be provided at a neighboring position to the peripheral surface of the photoreceptor, like developing means, electrifying means, transfer means and the like. When provided on the substrate side, the photoreceptor heating means 16 may be disposed at an arbitrary position. In this case, it is preferably designed so as to be a planar heater for heating the photoreceptor, which is closely and uniformly contacted with the inner side of the photoreceptor.

As the photoreceptor heating means, a heating lamp, for example, a quartz lamp formed by providing nichrome wires within quartz glass or a planar heater obtained by arranging nichrome wires within flexible rubber having a heat-resistance such as silicon rubber, may be used. In addition, a hot air blowing type heater, a heater utilizing radiative heat such as infrared rays, a heater utilizing the heat generated at the fixing unit and the like, may also be used. As power supply means to the above photoreceptor heating means, an arbitrary device may be used. In the case where the heating means is provided at the inside of a photoreceptor supporting member, it is preferable to employ a device which supplies a power through a slip ring thereto because the photoreceptor is rotated.

EMBODIMENT

The present invention will be described concretely with examples and comparative examples.

Using a capacity-coupled type plasma CVD apparatus which can form an amorphous silicon film on a cylindrical aluminum substrate, the mixture of silane ($SiH_4$) gas, hydrogen ($H_2$) gas and diborane ($B_2H_6$) gas are decomposed by glow discharge to form a charge injection blocking layer having thickness of about 4.3 μm on the cylindrical aluminum substrate. The manufacturing conditions for the above process were as follows:

| | |
|---|---|
| Flow rate of 100% silane gas | 180 $cm^3$/min, |
| Flow rate of 100% hydrogen gas | 90 $cm^3$/min, |
| Flow rate of diborane gas diluted with 20 ppm hydrogen | 90 $cm^3$/min, |
| Internal pressure of reactor | 1.0 Torr, |
| Discharge power | 200 W, |

-continued

| | |
|---|---|
| Discharge time | 60 min, |
| Discharge frequency | 13.56 MHz, |
| Substrate temperature | 250°C. |

(It is to be noted that the discharge frequency and the substrate temperature in the manufacturing conditions for each layer in the embodiment and the comparative examples to be described below were fixed to the values listed above.)

After forming a charge injection blocking layer, the inside of the reactor was thoroughly evacuated, and then the mixture of silane gas, hydrogen gas and diborane gas is introduced into the reactor to be decomposed by glow discharge, so that a photoconductive layer having a thickness of about 15 μm was formed on top of the charge injection blocking layer. The manufacturing conditions for the above process were as follows:

| | |
|---|---|
| Flow rate of 100% silane gas | 180 $cm^3$/min, |
| Flow rate of 100% hydrogen gas | 162 $cm^3$/min, |
| Flow rate of diborane gas diluted with 20 ppm hydrogen | 18 $cm^3$/min, |
| Internal pressure of reactor | 1.0 Torr, |
| Discharge power | 200 W, |
| Discharge time | 210 min. |

After the formation of the photoconductive layer, the inside of the reactor was evacuated thoroughly, and by introducing the mixture of silane gas, hydrogen gas and diborane gas and decomposing the mixture by glow discharge, a charge capturing layer having a thickness of about 0.9 μm was formed on the photoconductive layer. The manufacturing conditions for the above process were as follows.

| | |
|---|---|
| Flow rate of 100% silane gas | 180 $cm^3$/min, |
| Flow rate of 100% hydrogen gas | 90 $cm^3$/min, |
| Flow rate of diborane gas diluted with 20 ppm hydrogen | 90 $cm^3$/min, |
| Internal pressure of reactor | 1.0 Torr, |
| Discharge power | 200 W, |
| Discharge time | 12 min. |

After the formation of the charge capturing layer, the inside of the reactor was evacuated thoroughly, and by introducing the mixture of silane gas, hydrogen gas and ammonia ($NH_3$) gas in the reactor and decomposing the mixture by glow discharge, a first surface layer having a thickness of about 0.05 μm was formed on top of the charge capturing layer. The manufacturing conditions for the above process were as follows:

| | |
|---|---|
| Flow rate of 100% silane gas | 26 $cm^3$/min, |
| Flow rate of 100% hydrogen gas | 180 $cm^3$/min, |
| Flow rate of 100% ammonia gas | 30 $cm^3$/min, |
| Internal pressure of reactor | 0.5 Torr, |
| Discharge power | 50 W, |
| Discharge time | 6 min. |

After the formation of the first surface layer, by introducing the mixture of silane gas, hydrogen gas and ammonia gas and decomposing the mixture by glow discharge, a second surface layer having a thickness of about 0.25 μm was formed on top of the first surface layer. The manufacturing conditions for the above process were as follows:

| | |
|---|---|
| Flow rate of 100% silane gas | 24 $cm^3$/min, |
| Flow rate of 100% hydrogen gas | 180 $cm^3$/min, |
| Flow rate of 100% ammonia gas | 36 $cm^3$/min, |
| Internal pressure of reactor | 0.5 Torr, |
| Discharge power | 50 W, |
| Discharge time | 40 min. |

After for formation of the second surface layer, the mixture of silane gas, hydrogen gas and ammonia gas was introduced and the mixture was decomposed by glow discharge, to form a third surface layer having a thickness of about 0.1 μm on top of the second surface layer. The manufacturing conditions for the above process were as follows.

| | |
|---|---|
| Flow rate of 100% silane gas | 15 $cm^3$/min, |
| Flow rate of 100% hydrogen gas | 180 $cm^3$/min, |
| Flow rate of 100% ammonia gas | 43 $cm^3$/min, |
| Internal pressure of reactor | 0.5 Torr, |
| Discharge power | 50 W, |
| Discharge time | 20 min. |

As described above, there was obtained a photoreceptor having a charge injection blocking layer, a photoconductive layer, a charge capturing layer, a first surface layer, a second surface layer and a third surface layer on an aluminum substrate. The residual potential of the photoreceptor thus formed body was 45 V, and the sensitivity which is represented as the reciprocal of the light-exposure amount for half attenuation was 0.13 $cm^2$/erg for light of 450 nm.

Using this photoreceptor, an image quality evaluation test was carried out in a copying machine. A drum heating unit inside the copying machine was operated so as to heat the drum surface to a temperature of 45° C. on. This photoreceptor was able to produce a sharp image even after a copying test of about one hundred thousand printings, and there were observed no image fading or defect in image quality caused by flaws or the like on the photoreceptor.

COMPARATIVE EXAMPLE 1

By using the same apparatus, conditions and method as described in the Embodiment, a charge injection blocking layer, a photoconductive layer and charge capturing layer were successively formed on an aluminum substrate in this order.

After the formation of the charge capturing layer, the inside of the reactor was evacuated thoroughly, and then a first surface layer about 0.05 μm in thickness was formed under the same conditions to those of the first surface layer in the Embodiment.

After the formation of the first surface layer, a second surface layer was formed under the same conditions to those of the second surface layer in the Embodiment. However, the discharge time was changed to 16 min and the film thickness was chosen to be 0.1 μm.

After the formation of the second surface layer, a third surface layer about 0.1 μm in thickness was formed under the same conditions to those of the third surface layer in the Embodiment.

In the above manner, a photoreceptor having a charge injection blocking layer, a photoconductive layer, a charge capturing layer, a first surface layer, a second surface layer and a third surface layer on an aluminum substrate was obtained. The residual potential of the photoreceptor was 40 V, and the sensitivity represented as the reciprocal of the light-exposure amount for half attenuation was 0.17 $cm^2$/erg for light of 450 nm. Using this photoreceptor, an image quality evaluation test was carried out in the copying machine. The drum heating unit inside the copying machine was operated so as to heat the surface of the drum to a temperature of 45° C. After about fifty thousand sheets copying test, flaws corresponding to contact scars by the paper peeling finger provided in the copying machine began to the printed in this photoreceptor.

COMPARATIVE EXAMPLE 2

Using the same apparatus, conditions and method as described in the Embodiment, a charge injection blocking layer, a photoconductive layer and a charge capturing layer were successively formed on top of an aluminum substrate in this order.

After the formation of the charge injection blocking layer, the inside of the reactor was evacuated thoroughly, and a lower surface layer was formed under the same conditions as in the first surface layer in the Embodiment. However, the discharge time was set to be 25 min and the film thickness was chosen to be about 0.2 μm.

After the formation of the lower surface layer, an upper surface layer about 0.1 μm in thickness was formed under the same conditions as the third surface layer of the Embodiment.

As described above, a photoreceptor having a charge injection blocking layer, a photoconductive layer, a charge capturing layer, a lower surface layer and an upper surface layer on top of an aluminum substrate was obtained. The residual potential of this photoreceptor was 35 V, but the sensitivity was 0.05 $cm^2$/erg for a radiation of 450 nm, revealing disensitization.

COMPARATIVE EXAMPLE 3

Using the same apparatus, conditions and method as described in the Embodiment, a charge injection blocking layer, a photoconductive layer and a charge capturing layer were successively formed on an aluminum substrate in this order.

After the formation of the charge capturing layer, the inside of the reactor was evacuated thoroughly, and a lower surface layer about 0.05 μm in thickness was formed under the same conditions as those of the first surface layer in the Embodiment.

After the formation of the lower surface layer, an upper surface layer was formed under the same conditions as those of the third surface layer in the Embodiment. However, the discharge time was changed to 40 min and the film thickness was set to about 0.2 μm.

In the above manner, a photoreceptor having a charge injection blocking layer, a photoconductive layer, a charge capturing layer, a lower surface layer and an upper surface layer on an aluminum substrate was obtained. The sensitivity of the photoreceptor was about 0.20 $cm^2$/erg for light of 450 nm, and its residual potential has a high value of 80 V.

As described above, the photoreceptor according to the present invention provided an initial images of high quality and has an excellent stability independent on the lapse of time and a high resistance to printing. Further, the photoreceptor possesses a high light sensitivity over the entire visible ray region, the low residual voltage and a high dark resistance. In addition, the electrifying capability thereof is excellent. Still further, it possesses an excellent property having the low dependence of the characteristics on the environment at which it is used. Accordingly, copied images obtained have excellent resolution and gradation reproducibility, and can show a high density of image without fogging in both of the initial period and after repeated operation for a long time.

Moreover, the photoreceptor according to this invention can be effectively used, especially in an electrophotographic process which is operated under a condition that at least the surface of the photoreceptor is heated at a temperature in the range of 35°-50° C. That is, when used under conditions where the surface of the photoreceptor is heated at a temperature in the above temperature range, it gives a stable and high quality initial images, and will not be deteriorated in the image quality even after repeated operation, under any environment at which the photoreceptor is used.

What is claimed is:

1. A photoreceptor for electrography, comprising: a photoconductive layer, a first surface layer, a second surface layer and a third surface layer formed in sequence on a support, said photoconductive layer being substantially composed of amorphous silicon and said first, second and third surface layers being substantially composed of amorphous silicon added with nitrogen atoms, and wherein the film thicknesses $d_1$, $d_2$ and $d_3$ of said first, second and third surface layers and the nitrogen concentrations $c_1$, $c_2$ and $c_3$ of said first, second and third surface layers satisfy the following relation: $d_2>d_1$, $d_2>d_3$ and $c_3>c_2>c_1$.

2. A photoreceptor as claimed in claim 1, wherein said photoconductive layer contains a group III element in the range of 0.01-100 ppm.

3. A photoreceptor as claimed in claim 1, further comprising a charge injection blocking layer of amorphous silicon added with group III or a group V element in the range of 1-5,000 ppm, said charge injection blocking layer being interposed between said substrate and said photoconductive layer.

4. A photoreceptor as claimed in claim 2, further comprising a charge injection blocking layer of amorphous silicon added with a group III or a group V element in the range of 1-5,000 ppm, said charge injection blocking layer being interposed between said substrate and said photoconductive layer.

5. A photoreceptor as claimed any one of claims 1, 2, 3 and 4, further comprising a charge capturing layer of amorphous silicon added with a group III or a group V element in the range of 0.1-5,000 ppm, said charge capturing layer being interposed between said photoconductive layer and said first surface layer.

6. A photoreceptor for use in an electrophotographic process wherein at least the surface of said photoreceptor is heated to a temperature range of 35°-50° C., comprising:

a photoconductive layer, a first surface layer, a second surface layer and a third surface layer formed in sequence on a support, said photoconductive layer being substantially composed of amorphous silicon and said first, second and third surface layers being substantially composed of amorphous silicon added with nitrogen atoms, and wherein the film thicknesses $d_1$, $d_2$ and $d_3$ of said first, second and third surface layers and the nitrogen concentrations $c_1$, $c_2$ and $c_3$ of said first, second and third surface layers satisfy the following relation: $d_2>d_1$, $d_2>d_3$, and $c_3>c_2>c_1$.

* * * * *

UNITED STATES PATENT AND TRADEMARK OFFICE

CERTIFICATE OF CORRECTION

PATENT NO. : 5,008,170

DATED : April 16, 1991

INVENTOR(S) : Kenichi Karakida et al.

It is certified that error appears in the above-identified patent and that said Letters Patent is hereby corrected as shown below:

On the title page: change "PHOTORECEPTOR FOR ELECTROPHOTOGRAPHY" to --PHOTORECEPTOR FOR ELECTROPHOTOGRAPHY CONTAINING AMORPHOUS SILICON--;

Item [75] Inventors, change "Te N. Roh" to --Te Nam Roh--;

Abstract, Line 5, change "atom" to --atoms--;

Claim 1, Column 9, Line 1, change "electrography" to --electrophotography--;

UNITED STATES PATENT AND TRADEMARK OFFICE

CERTIFICATE OF CORRECTION

PATENT NO. : 5,008,170

DATED : April 16, 1991

INVENTOR(S) : Kenichi Karakida et al

It is certified that error appears in the above-identified patent and that said Letters Patent is hereby corrected as shown below:

Column 10, line 3, after "with" insert --a--: and

Column 10, line 13, after "claimed" insert --in--.

Signed and Sealed this

Sixteenth Day of February, 1993

*Attest:*

STEPHEN G. KUNIN

*Attesting Officer*

*Acting Commissioner of Patents and Trademarks*